United States Patent [19]

Griffin

[11] 4,126,223

[45] Nov. 21, 1978

[54] BARRIER DEVICE, PACKAGING AND METHOD

[76] Inventor: Richard J. Griffin, 848 S. Johnson Ct., Denver, Colo. 80226

[21] Appl. No.: 505,098

[22] Filed: Sep. 11, 1974

[51] Int. Cl.[2] ..... B65D 85/20; B65D 85/54

[52] U.S. Cl. ..... 206/445; 206/526

[58] Field of Search ..... 221/70, 74, 79, 81; 206/151, 158, 486, 445, 526

[56] References Cited

U.S. PATENT DOCUMENTS

| | | | |
|---|---|---|---|
| 3,095,677 | 7/1963 | Dreyfus et al. | 206/486 |
| 3,302,854 | 2/1967 | Midgley et al. | 206/151 |

*Primary Examiner*—Herbert F. Ross

[57] ABSTRACT

A barrier device, advantageously utilized to separate blood serum from other components by centrifuging, and preferably in the form of a truncated cone having stabilizer posts extending from the conical base in the direction of truncation and an axial post extending from the opposite, concave side is disclosed. A strip of pliable material having complementary depressions therein serves as a package and dispenser for the barrier device. Insertion into a test tube is preferably accomplished by placing the test tube in the opening of the depression and ejecting the barrier device by pressure against the post through the pliable packaging material.

5 Claims, 7 Drawing Figures

BARRIER DEVICE, PACKAGING AND METHOD

CROSS-REFERENCE TO RELATED APPLICATIONS

Reference is made to copending application for patent Ser. No. 390,354 entitled METHOD AND DEVICE FOR SEPARATING BLOOD COMPONENTS, filed Aug. 22, 1973, and assigned to the assignee of the present invention.

This invention relates broadly to a barrier device for use in separating liquids of different specific gravities from a mixture thereof, to packaging for the barrier device and to a method for inserting the barrier device into a test tube without touching or otherwsie contaminating the barrier device. More specifically, the invention is directed to a barrier device as heretofore used with an axially-extending post which, when packaged in a strip of pliable material, is so positioned within the pliable material as to permit ejection from the packaging in a rapid efficient manner.

Heretofore, the separation of blood clots and other components from blood serum by centrification has been advantageously accomplished by the use of a barrier device as disclosed in more detail in U.S. Pat. Application Ser. No. 390,354. While the previous barrier device has been most satisfactory with regard to obtaining sharp and prompt separation of various components, care has been required in the handling of the barrier device to avoid contamination prior to insertion into a test tube. Also, removal of the barrier device after use, and other handling, has been awkward as a result of the lack of purchase offered by the device in its operating mode.

Accordingly, an object of the present invention is to provide a novel and improved packaging arrangement of a strip of material with spaced depressions therein into each of which a barrier device having an axially-extending post can be inserted, secured and sealed for contamination-free storage.

Another object of the present invention is to provide a novel method and means by which the barrier device, when packaged in a depression in a pliable material, may be positioned over a test tube by placing the opening of the depression over the opened end of a test tube and ejecting the barrier device by pressure upon the pliable material against a post projecting axially from the barrier device.

When separating liquids of differing specific gravities through the use of a barrier device and a centrification process, it is often necessary, particularly in the instance of separating blood serum from other components thereof, to provide a substantially sterile barrier device in a test tube. Since it has heretofore been found that a barrier device in a form of a truncated cone with stabilizing guide means and an opening through the cone is particularly advantageous for such separations, the need for an improved means and method for handling such barrier devices has been noted. A truncated cone having guide means disposed, when in use, towards the bottom of a test tube and a concave section extending upward, when in such use, does not provide a convenient grasp or purchase for insertion and is rather difficult to remove from the test tube after the serum is decanted from the heavier components.

By providing a barrier device similar to that heretofore used but with a post member extending axially from the center of the concave portion of a truncated cone, it is possible to provide not only an ideal means for handling the barrier device, but also possible to provide an improved packaging means which obviates the need for handling of the barrier device upon insertion into the test tube.

A thin pliable strip of material having a series of dome-shaped depressions therein with the entrance of the depression of a size complementary to the opening of a test tube, a main portion of the depression complementary to the diameter of the barrier device, and an upper tapered portion, preferably dome-shaped, which is adapted to receive the post member, provides for the advantageous handling of the barrier device. When a barrier device is deposited in a depression, it is only necessary to place the opening of the depression over a test tube and press down upon the pliable packaging material to eject the barrier device into the test tube as a result of applied pressure to the post member. A covering may be provided over the depression opening for sterile transport and storage.

Other objects, advantages and capabilities of the present invention will become more apparent as the description proceeds taken in conjunction with the accompanying drawings, in which.

Figure 1:
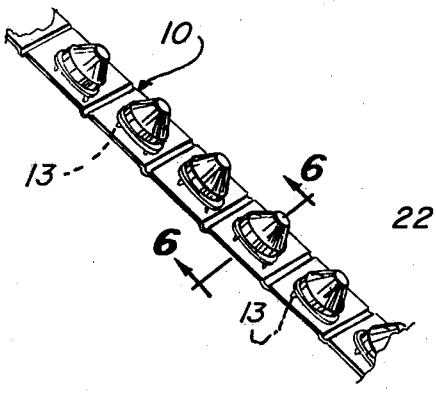
FIG. 1 illustrates in perspective the preferred packaging in strip form of barrier devices.
Figure 2:
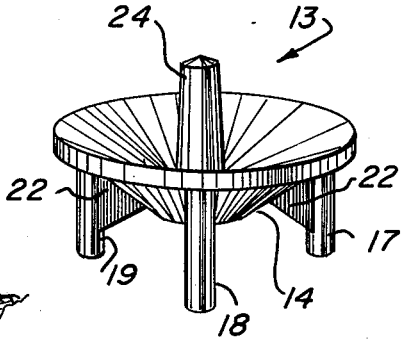
FIG. 2 illustrates in perspective the preferred form of the barrier device.
Figure 3:
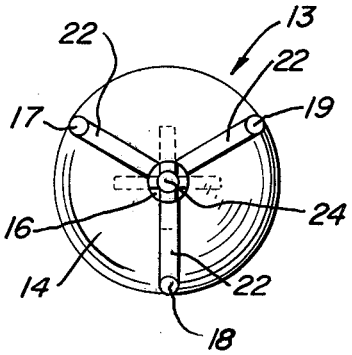
FIG. 3 is a bottom plan view of the preferred embodiment of the barrier device.
Figure 4:
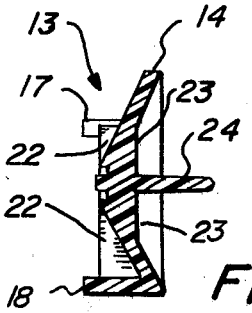
FIG. 4 is a cross-sectional view taken along line 4—4 of FIG. 5.
Figure 5:
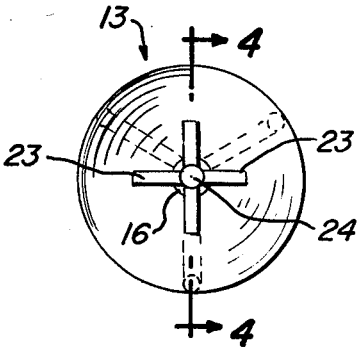
FIG. 5 is a top plan view of the barrier device.

Referring now to the drawings in detail, there is shown by way of illustrative examples in FIG. 1 a strip 10 of pliable material having depressions 12 defined therein. Depressions 12 are of a configuration appropriate to receive barrier device 13. Strip 10 is preferably transparent, as illustrated, but not necessarily so.

FIGS. 2 through 5 illustrate the preferred form of barrier device 13. As shown, barrier device 13 has a main body 14 in the form of a relatively flat truncated conical disc having a small central opening hole 16 located at the vertex of the cone. Three post-like guides or stabilizers 17, 18 and 19 are positioned at 120° intervals around the undersurface or base of the conical disc main body 14 and extending from the base parallel with the axis of the cone for a distance approximately equal to the height of the cone. Each stabilizer is provided with a radially reinforced rib or web 22 to maintain its structural rigidity. A cross-shaped web member 23 is provided in the interior or upper surface of the cone to reinforce the cone and incidentally serves to restrict the effective size of opening 18. A post member 24 extends axially from the center of the cross-shaped web member 23 a distance approximately twice that of the depth of main body 14, and at least a substantial distance from the opening of the cone.

Figure 6:
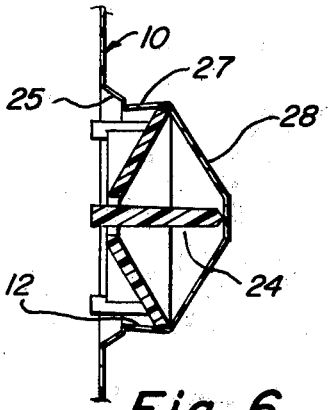
FIG. 6 is a cross-sectional view taken along line 6—6 of FIG. 1.

As illustrated in FIG. 6, depression 12 in strip 10 is, in fact, a series of openings of decreasing diameter. The initial opening is defined in cross section by wall 25 and delineates an opening substantially that of a test tube for which barrier device 13 is adapted for use. While a clearance of 0.005 inch between the outer diameter of main body 14 and the inner diameter of a test tube is preferred when using barrier device 13, it will be understood that beads on the upper portion of a test tube and the accommodation on the outside diameter of a test tube in the opening defined by wall 25 is not as critical. Wall 25 is preferably flared somewhat to accommodate various sized test tubes. The second opening is defined by reverse tapered portion 27 which is sized to provide an interference fit with the conical disc of barrier device 13. As a result of the taper, some distending of tapered portion 27 is necessary to remove barrier device 13.

Finally, a dome portion 28, preferably in the form again of a truncated cone, but operably of other similar configurations, is provided to accommodate, either in touching relationship or adjacent relationship, post member 24. Thus, it will be seen that barrier device 13 is securely constrained within depression 12 by means of the interference fit between tapered portion 27 of depression 12 and the larger diameter of the conical disc.

Figure 7:
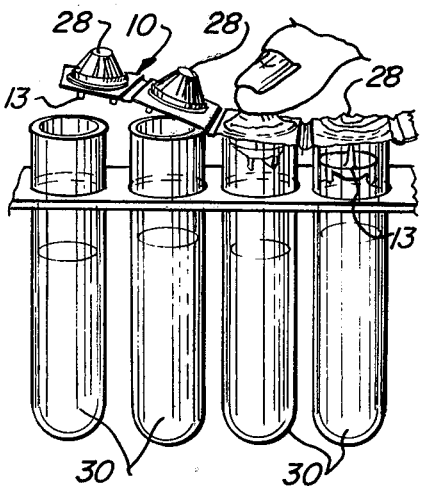
FIG. 7 illustrates the positioning and ejection of barrier devices into test tubes.

In use, as illustrated in FIG. 7, strip 10 having barrier devices 13 secured therein as described above is positioned over test tubes 30 with wall 25 of strip 10 engaging and positioning depression 12 over the test tube 30. Thus, when pressure is brought to bear upon dome portion 28 of strip 10, dome portion 28 deflects into contact with post member 24 thereby overcoming the interference fit between tapered portion 27 and the conical disc of barrier device 13. Accordingly, barrier device 13 drops into test tube 30 without having been directly touched by hands or instruments.

Strip 10 may be in a form of a continuous roll and may, in an obvious manner, be hermetically sealed to maintain sterilization by an individual or continuous seal (not shown) adhesively or otherwise secured to close individual depression 12. It has been found that a strip 10 of polyvinyl chloride, 5 to 10 mils thick, serves quite well as a material for strip 10. Of course, many other polymeric and other materials, as metal foils, will be apparent to those skilled in the art.

While for purposes of illustration, the invention has been discussed primarily with reference to the relationship between barrier device 13 and strip 10, it will, of course, be understood that the provision of post member 24 on barrier device 13 provides a more conveniently manipulated structure, a significant feature in view of the demanding environment and need to avoid contamination. It will also be understood that, while the preferred embodiments of the invention have been illustrated and described, changes in construction and specific detail may be made without departing from the spirit and scope of the invention as defined by the appended claims.

What is claimed is:

1. A packaged barrier device for separating components having different specific gravities by centrifugation, comprising: a strip of pliable material having at least one depression defined therein, the depression being in the form of an initial flared opening with the larger diameter of the opening adjacent the mouth of the depression, a tapered depression section adjacent the flared opening with the narrower portion of the tapered section connected to the narrower portion of the flared opening, and a domed end section connected to and extending from the enlarged portion of the tapered section, a circular barrier device positioned in the depression, the barrier device comprising a circular member having at least one opening therethrough and a post member extending axially from the center of the circular member, the circular member being received and secured in the depression at the tapered portion with the post member extending into the depression in close proximity to the domed portion of the material defining the depression.

2. A packaged barrier device as claimed in claim 1 in which the circular member comprises a truncated conical disc having stabilizer means positioned around the base of the cone and extending therefrom parallel to the axis of the cone in the direction of truncation and towards the opening of the depression, and in which the post member extends axially from the center of the cone in the opposite direction as the stabilizing means.

3. A packaged barrier device as claimed in claim 1 in which the strip material is about 5 to 10 mils thick.

4. A packaged barrier device as claimed in claim 3 in which the strip material is polyvinyl chloride.

5. A packaged barrier device as claimed in claim 1 in which the flared opening is of a diameter slightly larger than the outside diameter of the centrifuge tubes with which the barrier device is adapted for use.

* * * * *

UNITED STATES PATENT OFFICE

CERTIFICATE OF CORRECTION

Patent No. 4,126,223 Dated November 21, 1978

Inventor(s) Richard J. Griffin

It is certified that error appears in the above-identified patent and that said Letters Patent are hereby corrected as shown below:

ON THE TITLE PAGE:

After the listing of the inventor, add:

-- Assignee: Telan Corporation, Denver, Colorado --

IN THE SPECIFICATION:

Column 1, line 10, after "1973," add:

-- now patent number 4,001,122, granted January 4, 1977 --.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*